US009386811B1

(12) United States Patent
Hozen

(10) Patent No.: US 9,386,811 B1
(45) Date of Patent: Jul. 12, 2016

(54) CHEST AND RIB PROTECTIVE PADDED SHIRT

(71) Applicant: Jack Hozen, Silverton, OR (US)

(72) Inventor: Jack Hozen, Silverton, OR (US)

( * ) Notice: Subject to any disclaimer, the term of this patent is extended or adjusted under 35 U.S.C. 154(b) by 0 days.

(21) Appl. No.: 14/467,364

(22) Filed: Aug. 25, 2014

Related U.S. Application Data

(63) Continuation-in-part of application No. 13/523,991, filed on Jun. 15, 2012, now abandoned.

(51) Int. Cl.

| | |
|---|---|
| ***A41D 13/00*** | (2006.01) |
| ***A41D 13/015*** | (2006.01) |
| ***A41D 13/05*** | (2006.01) |
| ***A41B 1/08*** | (2006.01) |

(52) U.S. Cl.
CPC ..... *A41D 13/015* (2013.01); *A41B 1/08* (2013.01); *A41D 13/0518* (2013.01)

(58) Field of Classification Search
CPC ..... A63B 2071/1208; A63B 2208/0257; A41D 13/0525
See application file for complete search history.

(56) References Cited

U.S. PATENT DOCUMENTS

| | | | | |
|---|---|---|---|---|
| 6,678,899 | B2 * | 1/2004 | Fiorini | A41D 13/0518 D13/518 |
| D505,771 | S * | 6/2005 | Herman | D2/733 |
| 2006/0073943 | A1 * | 4/2006 | Perka | A41D 13/0525 D13/525 |

* cited by examiner

*Primary Examiner* — Anna Kinsaul
(74) *Attorney, Agent, or Firm* — Plager Schack LLP

(57) ABSTRACT

A chest and rib protection padded shirt, configured to lift a human user's head from a surfboard while providing protection to a human user's chest and ribs. The chest and rib protection padded shirt includes a shirt attached to padding. The padding further includes a plurality of primary pads, secondary pads, tertiary pads, quaternary pads, and quinary pads having a quinary plurality of pads thickness. The primary plurality of pads thickness is greater than the secondary plurality of pads thickness. The secondary plurality of pads thickness is greater than the tertiary plurality of pads thickness. The tertiary plurality of pads thickness is greater than the quaternary plurality of pads thickness. The quaternary plurality of pads thickness is greater than the quinary plurality of pads thickness. The padding is adequate to prevent rib injuries while configured to lift the human user's head from the surfboard without the neck strain.

5 Claims, 3 Drawing Sheets

CHEST AND RIB PROTECTIVE PADDED SHIRT

RELATED APPLICATION

This application is a continuation-in-part of non-provisional patent application U.S. Ser. No. 13/523,991 filed on Jun. 15, 2012 the entire contents of which is herein incorporated by reference.

BACKGROUND

The embodiments herein relate generally to athletic apparel.

Surfing is dangerous, the force caused by waves and crashing by the surfer can cause serious damage to the ribs and sternum. Presently, existing athletic wear does little to stop bruised ribs and sternum caused from surfing. Other sports have similar difficulties, in the lack of lightweight protection for chest, rib, and other vital organs for many contact sports.

Prior art solutions are ineffective. Uncomfortable large pads and sloppy shirt designs have customers wanting something that is more form fitting and comfortable while playing sports.

The disclosed invention responds to the long felt need.

SUMMARY

A chest and rib protection padded shirt can be configured to lift a human user's head from a surfboard while providing protection to a human user's chest and ribs. The chest and rib protection padded shirt can include a shirt attached to padding. The padding can further include a plurality of primary pads having a primary plurality of pads thickness. A plurality of secondary pads can have a secondary plurality of pads thickness. A plurality of tertiary pads can have a tertiary plurality of pads thickness. A plurality of quaternary pads can have a quaternary plurality of pads thickness. A plurality of quinary pads can have a quinary plurality of pads thickness. The primary plurality of pads thickness can be greater than the secondary plurality of pads thickness. The secondary plurality of pads thickness can be greater than the tertiary plurality of pads thickness. The tertiary plurality of pads thickness can be greater than the quaternary plurality of pads thickness. The quaternary plurality of pads thickness can be greater than the quinary plurality of pads thickness. The padding can be adequate to prevent rib injuries while configured to lift the human user's head from the surfboard without the neck strain.

In some embodiments, the plurality of primary pads can further comprise a primary front pad, a primary left center pad, a primary right center pad, a primary left pad, a primary right pad, a primary left outer pad and a primary right outer pad. The plurality of secondary pads can further comprise a secondary front pad, a secondary left pad, a secondary right pad, a secondary left outer pad, a secondary right outer pad, a secondary left side pad, and a secondary right side pad. The plurality of tertiary pads can further comprise a tertiary front pad, a tertiary left pad, a tertiary right pad, a tertiary left outer pad, a tertiary right outer pad, a tertiary left side pad, and a tertiary right side pad. The plurality of quaternary pads can further comprise a quaternary front pad, a quaternary left pad, a quaternary right pad, a quaternary left outer pad, a quaternary right outer pad, a quaternary left side pad, and a quaternary right side pad. The plurality of quinary pads can further comprise a quinary front pad, a quinary left pad, a quinary right pad, a quinary left outer pad, and a quinary right outer pad.

The padding arrangement is shown in detail in FIG. 1. The pads are arranged such that the primary pads are positioned under the top left pad, top right pad and upper center pad. The primary pads are further arranged where the primary left and right center pads are respectively positioned adjacent the primary front pad, the primary left and right pads are respectively positioned adjacent the primary left and right center pads, and the primary left and right outer pads are respectively positioned adjacent the primary left and right pads. A left upper channel (not labeled but shown in FIG. 1) is arranged continuously between the top left pad and the upper center pad, around and beneath the primary left center pad, beneath the primary left pad and beneath the primary left outer pad. A right upper channel (not labeled but shown in FIG. 1) is arranged continuously between the top right pad and the upper center pad, around and beneath the primary right center pad, beneath the primary right pad and beneath the primary right outer pad. Underneath the plurality of primary pads, the respective plurality of secondary, tertiary, quaternary, and quinary pads are positioned sequentially.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
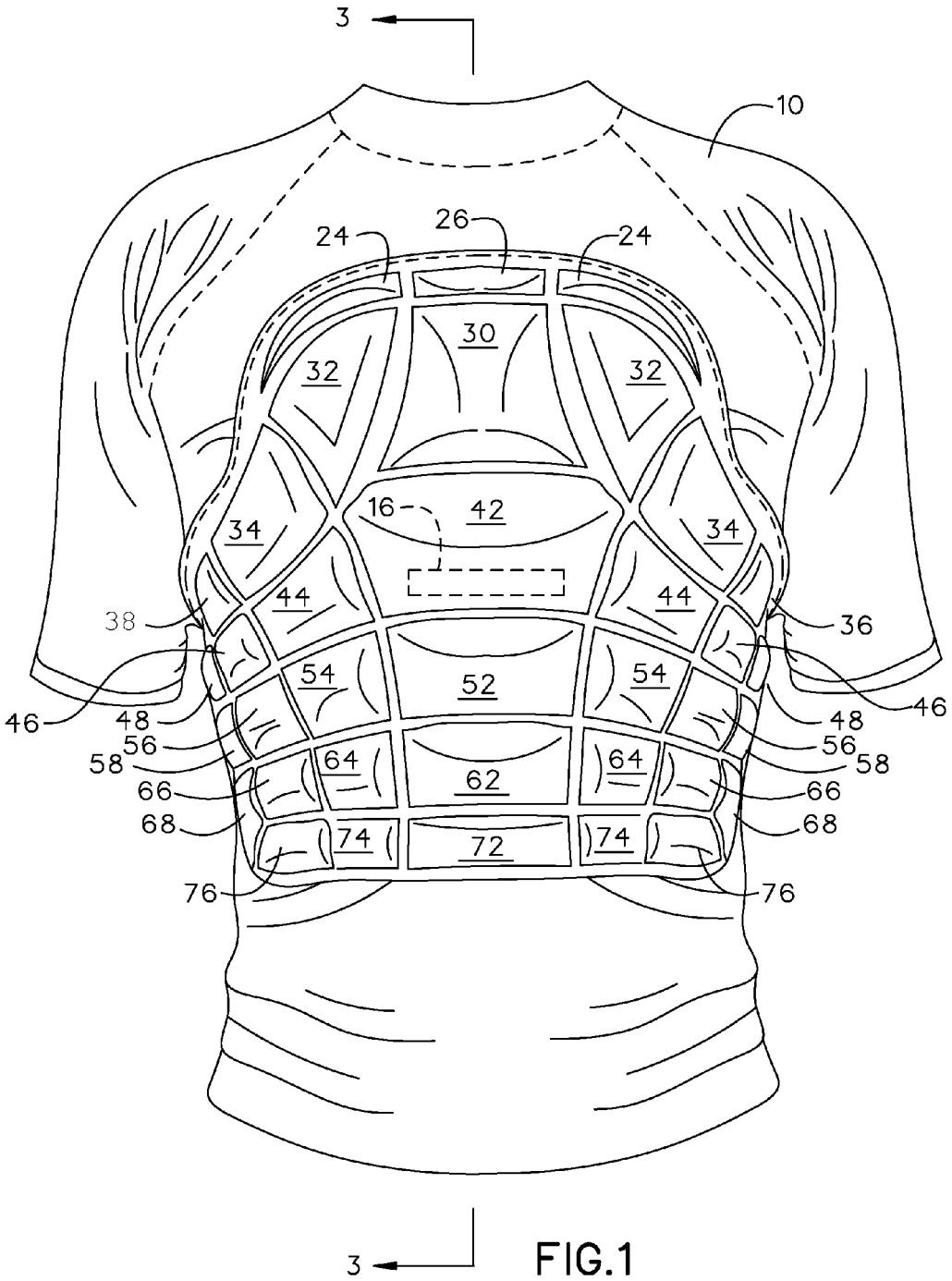
FIG. 1 is a front view of an embodiment of the invention.

By way of example, and referring to FIG. 1, one embodiment of the present system comprises shirt 10 mechanically coupled to padding 14. Similarly, shirt 10 is mechanically coupled to top left pad 24, top right pad 24, upper center pad 26. Top left pad 24 and top right pad 24 each have a modified wedge shape and are truncated such that top left pad 24 and top right pad 24 do not interfere with cross body motion.

Figure 5:
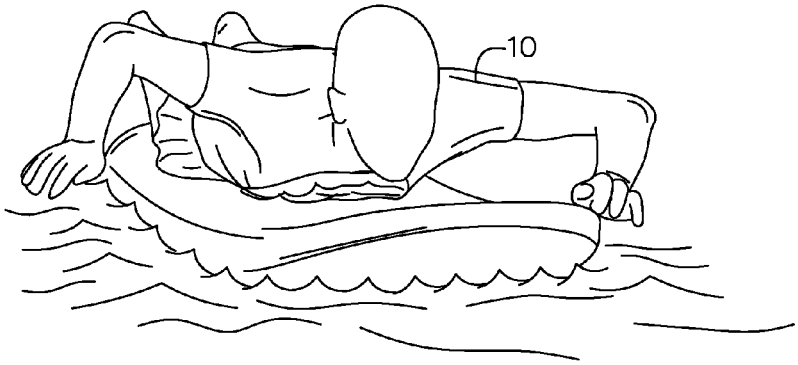
FIG. 5 is a prospective view of an embodiment of the invention in use.

Padding 14 further comprises a plurality of primary pads including: primary front pad 30, primary left center pad 32, primary right center pad 32, primary left pad 34, primary right pad 34, primary left outer pad 36 and primary right outer pad 38. Primary front pad 30 has a modified trapezoid shape in order to lift a human user's head from a surfboard without causing neck strain as shown in FIG. 5. Left upper pad 32 and right upper pad 32 each have a modified triangular shape and are configured to fold inward toward primary front pad 30 when a human user engages in cross body movement (such as moving a right arm across the body to the left) to maintain chest and rib protection without interfering with a full range of arm motion. Likewise primary left pad 34, primary right pad 34, primary left outer pad 36 and primary right outer pad 36 descend laterally away from a user's armpit to avoid interfering with arm movement. In this regard, primary left pad 34, primary right pad 34 have the shape of a modified quadrilateral while primary left outer pad 36 and primary right outer pad 36 take the shape of a modified triangle.

Padding 14 further comprises a plurality of secondary pads including: secondary front pad 42, secondary left pad 44, secondary right pad 44, secondary left outer pad 46, secondary right outer pad 46, secondary left side pad 48, and secondary right side pad 48. Secondary front pad 42 has a modified trapezoid shape in order to lift a human user's head from a surfboard without causing neck strain as shown in FIG. 5. Secondary left pad 44, secondary right pad 44, secondary left outer pad 46, secondary right outer pad 46, secondary left side pad 48, and secondary right side pad 48 angle upward and outward to provide protection to a user's ribs while avoiding interfere with arm movement.

Padding 14 further comprises a plurality of tertiary pads including: tertiary front pad 52, tertiary left pad 54, tertiary right pad 54, tertiary left outer pad 56, tertiary right outer pad 56, tertiary left side pad 58, and tertiary right side pad 58. Tertiary front pad 52 has a modified trapezoid shape in order to lift a human user's head from a surfboard without causing neck strain as shown in FIG. 5. Tertiary left pad 54, tertiary right pad 54, tertiary left outer pad 56, tertiary right outer pad 56, tertiary left side pad 58, and tertiary right side pad 58 angle upward and outward to provide protection to a user's ribs while avoiding interfere with arm movement.

Padding 14 further comprises a plurality of quaternary pads including: quaternary front pad 62, quaternary left pad 64, quaternary right pad 64, quaternary left outer pad 66, quaternary right outer pad 66, quaternary left side pad 68, and quaternary right side pad 68. Quaternary front pad 62 has a modified trapezoid shape in order to lift a human user's head from a surfboard without causing neck strain as shown in FIG. 5. Quaternary left pad 64, quaternary right pad 64, quaternary left outer pad 66, quaternary right outer pad 66, quaternary left side pad 68, and quaternary right side pad 68 angle upward and outward to provide protection to a user's ribs while avoiding interfere with arm movement.

Padding 14 further comprises a plurality of quinary pads including: quinary front pad 72, quinary left pad 74, quinary right pad 74, quinary left outer pad 76 and quinary right outer pad 76. Quinary front pad 72 has a modified trapezoid shape in order to lift a human user's head from a surfboard without causing neck strain as shown in FIG. 5. Quinary left pad 74, quinary right pad 74, quinary left outer pad 76, and quinary right outer pad 76, angle upward and outward to provide protection to a user's ribs while avoiding interfere with arm movement.

Figure 2:
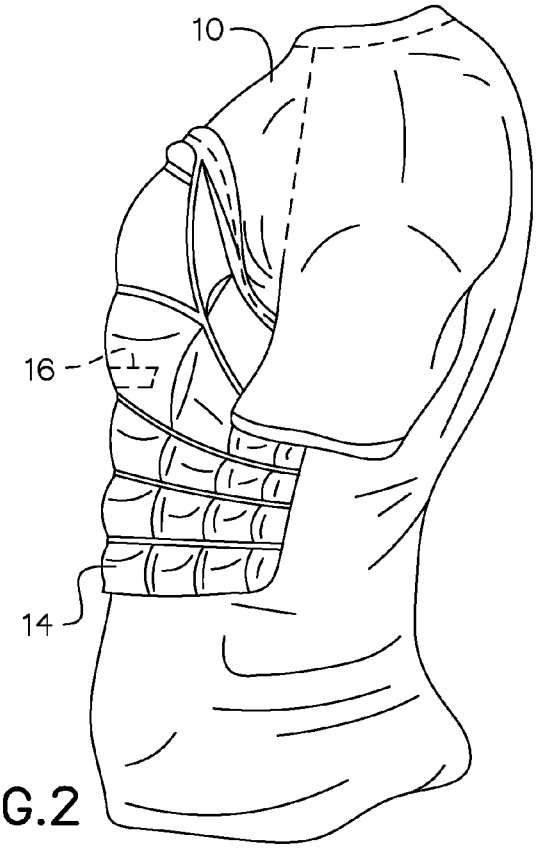
FIG. 2 is a side view of an embodiment of the invention.

FIG. 1 and FIG. 2 show a front view and side view of the invention. In this invention a user desires to surf but does not desire bruised ribs or a broken sternum should something go awry. The present invention solves this problem by strategically placing pad 14 on shirt 10. In order to discern the placement of pad 14 the user must conduct a series of trials on prospective users to determine where the prospective users are most likely to receive contact near vital organs. However, there must still be adequate movement of arms to ensure safety. As noted above, bulky padding is rather ineffective at enabling a user's movement.

To make a chest protective padded shirt, shirt 10 is mechanically coupled to pad 14 and further comprises label region 16. Shirt 14 is made by sewing a front panel to a back panel and then to sleeves and a collar as is well known in this field. While many materials for shirt 10 are possible super stretch lycra content fabric has proven to be most effective. Pad 14 can also be made from many materials, but molded plastic has proven to be most effective. Once the materials have been assembled, sew pad 14 onto the front fabric panel of shirt 10, then complete sewing shirt 10 to predetermined specifications on flat seam sewing machine for no bump seams.

Figure 3:
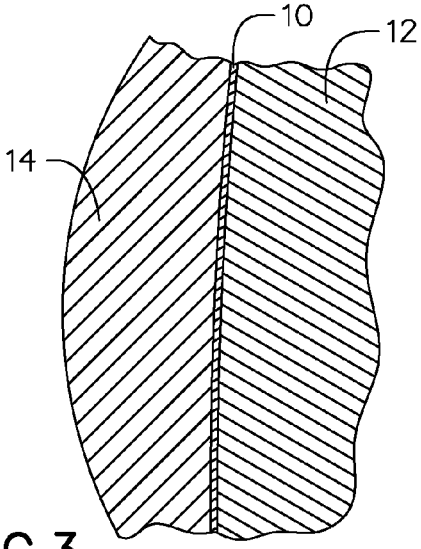
FIG. 3 is a detail section view of an embodiment of the invention along line 3-3 in FIG. 1.
Figure 4:
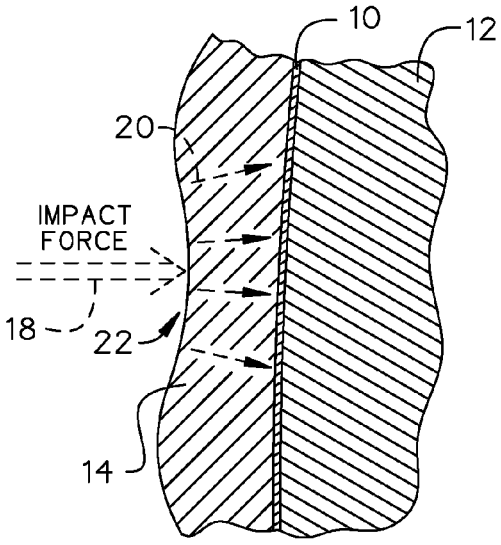
FIG. 4 is a detail section view of an embodiment of the invention illustrating distribution exemplary force upon impact incident.

FIG. 3 and FIG. 4 show a section view of shirt 10. As noted above, shirt 10 is mechanically coupled to pad 14 to protect user 12. When impact force 18 contacts pad 14, pad 14 becomes deformed and pad 14 converts impact force 18 into distributed force 20 throughout pad 14. Notice that user 12 does not deform as a result of impact force 18, a unique feature of pad 14.

Figure 6:
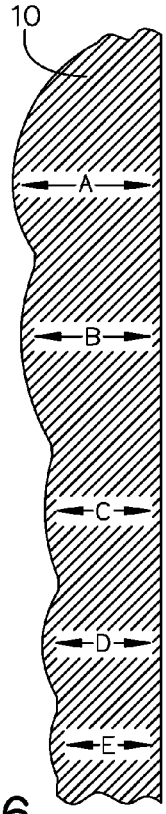
FIG. 6 is a section view of an embodiment of the invention.

FIG. 5 and FIG. 6 demonstrate how shirt 10 is configured to lift a human user from a surfboard. The plurality of primary pads has primary plurality of pads thickness A. The plurality of secondary pads has secondary plurality of pads thickness B. The plurality of tertiary pads has tertiary plurality of pads thickness C. The plurality of quaternary pads has quaternary plurality of pads thickness D. The plurality of quinary pads has quinary plurality of pads thickness E.

Primary plurality of pad thickness A is greater than secondary plurality of pad thickness B. Secondary plurality of pad thickness B is greater than tertiary plurality of pad thickness C. Tertiary plurality of pad thickness C is greater than quaternary plurality of pad thickness D. Quaternary plurality of pad thickness D is greater than quinary plurality of pad thickness E. In this regard, padding is adequate to prevent rib injuries while configured to assist a human user in lifting one's head from a surfboard without neck strain. An inverse arrangement, for instance, would exacerbate these problems.

Figure 7:
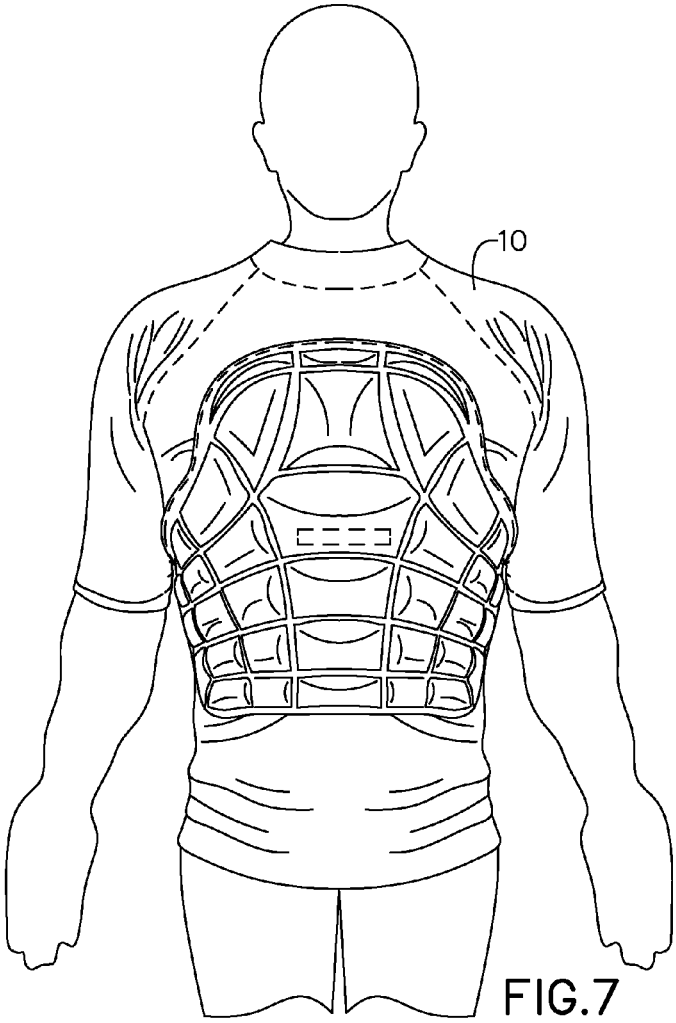
FIG. 7 is a front view of an embodiment of the invention in use.

To prevent padding 14 from becoming misaligned on a human user, shirt 10 should extend past the hips of the human user as shown in FIG. 7.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A chest and rib protection padded shirt, configured to lift a human user's head from a surfboard while providing protection to a human user's chest and ribs; the chest and rib protection padded shirt comprising:

a shirt attached to padding wherein the padding further comprises:

a top left pad and top right pad on either side of an upper center pad; wherein the top left pad and the top right pad each have a modified wedge shape and are truncated such that the top left pad and the top right pad do not interfere with cross body motion;

a plurality of primary pads having a primary plurality of pads thickness, the primary pads positioned under the top left pad, top right pad and upper center pad; the primary pads further comprise: a primary front pad, a primary left center pad, a primary right center pad, a primary left pad, a primary right pad, a primary left outer pad and a primary right outer pad; the primary left and right center pads respectively positioned adjacent the primary front pad, the primary left and right pads respectively positioned adjacent the primary left and right center pads, and the primary left and right outer pads respectively positioned adjacent the primary left and right pads;

a left upper channel arranged continuously between the top left pad and the upper center pad, around and beneath the primary left center pad, beneath the primary left pad and beneath the primary left outer pad;

a right upper channel arranged continuously between the top right pad and the upper center pad, around and beneath the primary right center pad, beneath the primary right pad and beneath the primary right outer pad;

a plurality of secondary pads having a secondary plurality of pads thickness;

a plurality of tertiary pads having a tertiary plurality of pads thickness;

a plurality of quaternary pads having a quaternary plurality of pads thickness; and a plurality of quinary pads having a quinary plurality of pads thickness;

wherein the respective plurality of secondary, tertiary, quaternary, and quinary pads are positioned sequentially under the plurality of primary pads;

wherein the primary plurality of pads thickness is greater than the secondary plurality of pads thickness; the secondary plurality of pads thickness is greater than the tertiary plurality of pads thickness; the tertiary plurality of pads thickness is greater than the quaternary plurality of pads thickness; the quaternary plurality of pads thickness is greater than the quinary plurality of pads thickness;

wherein the padding is adequate to prevent rib injuries while configured to lift the human user's head from the surfboard without the neck strain.

2. The chest and rib protection padded shirt of claim 1, wherein the plurality of secondary pads further comprise: a secondary front pad, a secondary left pad, a secondary right pad, a secondary left outer pad, a secondary right outer pad, a secondary left side pad, and a secondary right side pad.

3. The chest and rib protection padded shirt of claim 2, wherein the plurality of tertiary pads further comprise: a tertiary front pad, a tertiary left pad, a tertiary right pad, a tertiary left outer pad, a tertiary right outer pad, a tertiary left side pad, and a tertiary right side pad.

4. The chest and rib protection padded shirt of claim 3, wherein the plurality of quaternary pads further comprise: a quaternary front pad, a quaternary left pad, a quaternary right pad, a quaternary left outer pad, a quaternary right outer pad, a quaternary left side pad, and a quaternary right side pad.

5. The chest and rib protection padded shirt of claim 4, wherein the plurality of quinary pads further comprise: a quinary front pad, a quinary left pad, a quinary right pad, a quinary left outer pad, and a quinary right outer pad.

* * * * *